United States Patent [19]

Makus

[11] Patent Number: 4,804,166

[45] Date of Patent: Feb. 14, 1989

[54] ATTACHING CLIP

[76] Inventor: Gilbert Makus, P.O. Box 171, Buellton, Calif. 93427

[21] Appl. No.: 68,425

[22] Filed: Jul. 1, 1987

[51] Int. Cl.[4] ..... E04H 17/02; F16L 3/12

[52] U.S. Cl. ..... 256/48; 256/54; 256/68; 248/74.2; 248/231.8; 248/71; 403/406.1

[58] Field of Search ..... 256/48, 47, 55, 54, 256/56, 68, 50, 49, DIG. 3; 403/406.1, 405.1; 411/502, 503, 501; 248/74.2, 72, 71, 74.1, 74.4, 74.5, 231.8, 229; 24/457, 458

[56] References Cited

U.S. PATENT DOCUMENTS

| | | | |
|---|---|---|---|
| 1,016,151 | 1/1912 | Huber | 256/48 X |
| 1,057,260 | 3/1913 | Murray | 256/54 |
| 1,081,845 | 12/1913 | Lehrke | 256/48 |
| 1,136,746 | 4/1915 | White | 256/48 |
| 1,925,488 | 9/1933 | Kern | 256/48 X |
| 2,520,725 | 8/1950 | Judd | 403/406.1 X |
| 3,015,869 | 1/1962 | Rapata | 248/71 |
| 3,314,465 | 4/1967 | Bien | 403/406.1 X |
| 3,972,110 | 8/1976 | Sasena | 256/54 X |
| 4,180,247 | 12/1979 | Pfarr, Jr. | 256/68 X |

*Primary Examiner*—Randolph A. Reese
*Assistant Examiner*—Peter M. Cuomo
*Attorney, Agent, or Firm*—Marvin E. Jacobs

[57] ABSTRACT

A metal clip is formed with an arcuate front base portion having a pair of generally C-shaped flange side anchor portions projecting from folded back edges of the clip. Fencing materials such as wire or rails are attached to a flange projecting from the bottom edge of the clip. When the clip is inserted into a channel with inwardly turned edges the C-shaped flanges clip onto the edges. When the arcuate front base portion of the clip is flattened by striking with a hammer, the C-shaped flanges rotate into locking engagement with the inwardly rolled edges of the channel.

7 Claims, 1 Drawing Sheet

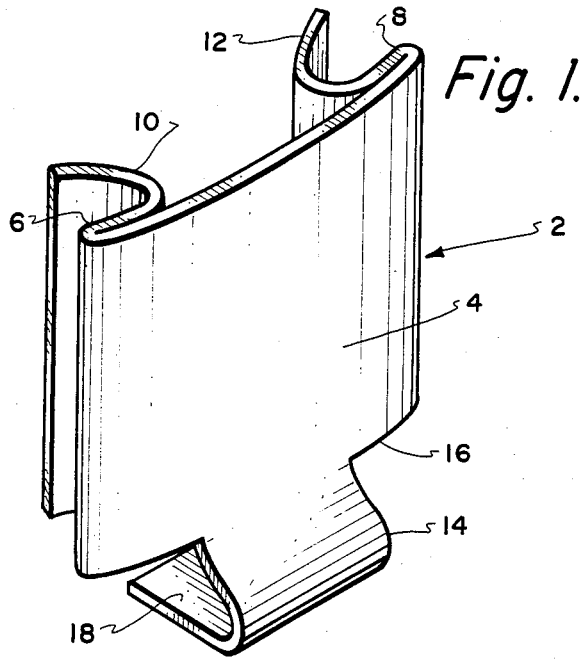
Fig. 1.
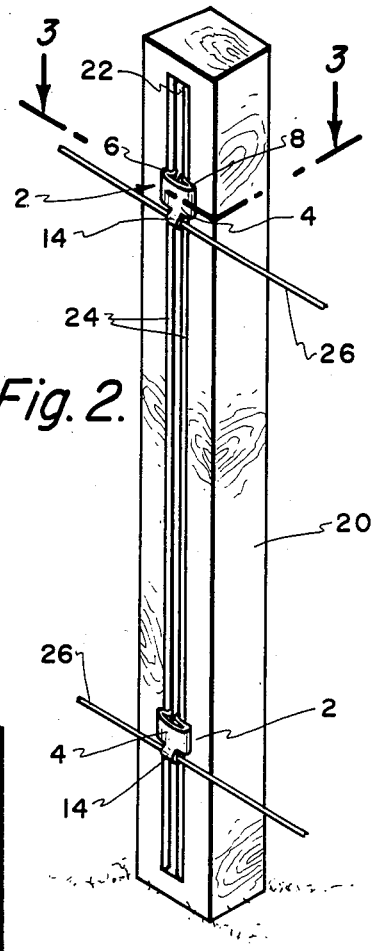
Fig. 2.
Fig. 3.
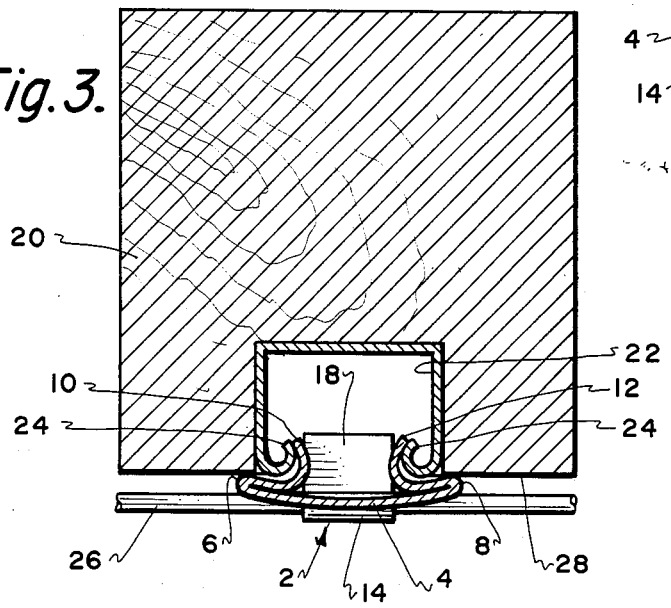
Fig. 4.
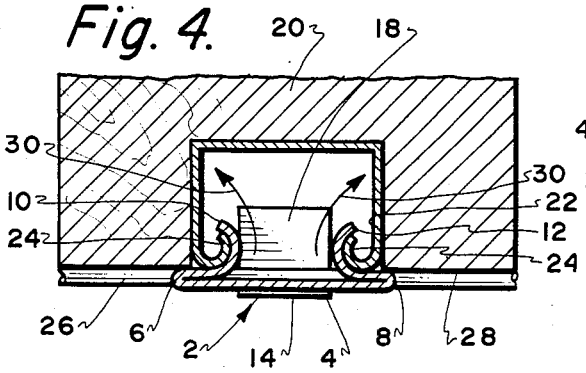
Fig. 5.
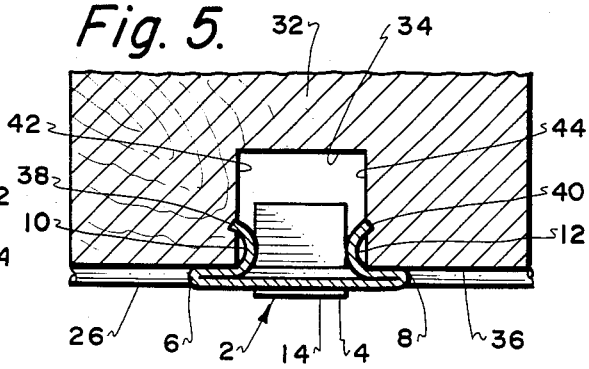

ATTACHING CLIP

FIELD OF INVENTION

This invention relates to attaching means and is particularly directed to novel attaching means for securing wires or the like to fence posts.

PRIOR ART

There are numerous varieties of concrete fence posts and means for attaching wires or other elements thereto disclosed in the prior art. U.S. Pat. No. 1,334,881 to Bennett, for example, shows a reinforced concrete post which contains reinforcing wires and having a fibrous securing strip attached to the post by bolts. U.S. Pat. No. 888,719 to Mendenhall shows use of a plurality of bolts embedded in a concrete fence post to attach a clamping bar to the post. U.S. Pat. No. 1,093,426 to Irwin discloses a fence post formed with a generally U-shaped portion having obliquely-inwardly turned edges. Various elements may be attached to the post by means of nuts and bolts. U.S. Pat. No. 824,117 to Hiltner shows a fence post having a channel member which is generally U-shaped having lips which are reversely-turned to 180 degrees. Various types of retaining means are inserted into the channel and are tightened against the lips to secure elements to the post.

Copending patent application, Ser. No. 619,941, filed June 12, 1984, now abandoned, discloses a fence post having a U-shaped channel formed with edges which are reversely-turned in excess of 180 degrees. Various means are disclosed for attaching elements to the fence posts.

The attaching means disclosed in the copending application utilizes nuts and bolts. However, this usually requires that one element of the attaching means, such as a nut, be inserted into the channel of the fence post and be secured in place by another element, such as a bolt. This necessitates the positioning of the first element and maintaining the first element in the desired position within the channel of the fence post until the second element is secured. Frequently, during such operations, one or both of the attaching elements will slip out of place or be dropped or misplaced which further delays attaching the desired element to the fence post. Furthermore, many of the prior attaching means are useful only at certain predetermined positions on the fence post and cannot be used at other locations. This greatly limits the usefulness of such devices.

STATEMENT OF THE INVENTION

These disadvantages of prior art attaching means are overcme with the novel attaching means provided by the present invention. The attaching means of the invention are useful with substantially any type of fence post having an attachment channel and which may be secured at any desired location along such a channel. Moreover, the attaching means of the present invention are unitary devices which do not require mating or cooperation with other attaching elements and can be installed with a minimum of time and effort.

The advantages of the present invention are preferably attained by providing novel attaching means comprising a sheet metal clip formed with a front base portion having a pair of generally side anchor portions in the form of C-shaped flange members projecting from the rear surface thereof adjacent the opposite edges of the clip, together with an attaching portion such as a flange projecting from the bottom edge of the clip to engage and retain a wire or the like to be secured to the fence post. Other attaching means such as sleeves for a rectangular or cylindrical rail or a threaded hole may be provided for securing other hanger or hinge or other assemblies.

The present invention thus provides improved attaching means for securing desired elements to fence posts and is useful. The unitary devices of the invention do not require mating or cooperation with one or more additional attaching elements and can be installed with a minimum of time.

These and other advantages and attendant features of the present invention will be apparent as the invention becomes better understood from the following detailed description when considered in conjunction with the accompanying drawings.

BRIEF DESCRIPTION OF THE DRAWINGS

FIG. 1 is an isometric view of an attaching device embodying the present invention;

FIG. 2 is an isometric view showing the attachment device of FIG. 1 securing a wire to a cement fence post having a channel member, as taught by my copending application Ser. No. 619,941, now abandoned;

FIG. 3 is a horizontal section along line 3—3 of FIG. 2 showing the attachment device of FIG. 1 positioned for attachment to said fence post with the clip still in arcuate form;

FIG. 4 is a view similar to that of FIG. 3 showing the attachment device of FIG. 1 in its secured position with the front face of the device flattened; and FIG. 5 is a horizontal section through an alternative form of fence post showing the attachment device of FIG. 1 secured thereto.

DETAILED DESCRIPTION OF INVENTION

In that form of the present invention chosen for purposes of illustration in the drawing, FIG. 1 shows an attachment device, indicated generally at 2, comprising a clip member formed of sheet metal and having a front base portion 4. The lateral edges 6 and 8 of the base portion 4 of the clip member 2 are reversely turned or folded back upon the base portion 4 on a rear side thereof, and then are reversely turned inwardly to form a pair of side anchor portions in the form of generally C-shaped flanges 10 and 12. Finally, a securing flange 14 projects outwardly and downwardly from the bottom edge 16 of the front base portion 4 of the clip member 2 and has the lower end thereof extending horizontally rearward, as seen at 18.

As seen in FIGS. 2, 3 and 4, the clip member 2 is preferably used for attaching desired elements to a fence post, indicated at 20, provided with a generally U-shaped channel member 22 having the free edges 24 thereof reversely turned through at least 180 degrees, preferably 180 degrees to 220 degrees, as taught in my copending patent application, Ser. No. 619,941, filed June 12, 1984, now abandoned, the disclosure of which is expressly incorporated herein by reference.

FIG. 3 shows the clip member 2 positioned for securing to the fence post 20 and, as shown, the flanges 10 and 12 of the clip 2 are inserted into the channel member 22 and lie immediately adjacent the reversely-turned edges 24 of the channel member 22. It will be clear from FIGS. 2 and 3 that the clip member 2 may be slid upwardly or downwardly along the channel member 22 to substantially any desired position. A wire 26, or other element to be attached to the fence post 20 may be engaged by the securing flange 14 of the clip 2 prior to insertion of the flanges 10 and 12 of the clip 2 into the channel 22.

When the clip member 2 is in the position shown in FIG. 3 prior to securing, it will be seen that the lateral edges 6 and 8 of the clip 2 engage the front base portion 4 of the folded back surface 28 of the fence post 20, while the front base portion 4 of the clip 2 forms an arcuate convex arc in cross-section between the edges 6 and 8. Also, as noted above, the flanges 10 and 12 of the clip 2 lie immediately adjacent the edges 24 of the channel member 22.

To secure the clip in a desired position along the channel member 22, the arcuate front base portion 4 of the clip 2 at its front side is struck with a hammer or the like to flatten the base portion 4 to a generally planar configuration in cross-section between the edges 6 and 8, as shown in FIG. 4. The flattening of the arcuate base portion 4 of the clip 2 causes the flanges 10 and 12 to be rotated outwardly, as indicated by arrows 30, causing the flanges 10 and 12 to grip the adjacent edges 24 of the channel member 22 to resiliently secure the clip 2 to the channel member 22 and, hence, to secure the wire 26 or the like to the fence post 20.

FIG. 5 shows the clip 2 of the present invention secured to a fence post 32 formed with a recess 34 which is not provided with a channel member 22. The fence post 32 may be formed of wood, cementitious material, metal or other suitable material. To attach a desired element to the fence post 32, the clip member 2 of the present invention is positioned with the flanges 10 and 12 inserted into the recess 34 and with the edges 6 and 8 of the clip 2 engaging the outer surface 36 of the fence post 32. The clip 2 is slid along the recess 34 to a desired position and is then secured by striking the arcuate surface 4 of the clip 2 with a hammer in the manner described above. The C-shaped flanges 10 and 12 of the clip 2 have acute edges 38 and 40 which engage the sides 42 and 44 of the recess 34 and, when the arcuate surfaces 4 of the clip 2 is deformed, the acute edges 38 and 40 bite into the sides 42 and 44 of the recess 34 to secure the clip to the post 32.

Obviously, the form of the securing flange 14 of the clip 2 may be altered to accommodate securing other desired elements, such as boards, poles, pipes and the like. Moreover, it will be apparent that the clip 2 may be employed with numerous forms of fence posts other than those shown.

It is to be realized that only preferred embodiments of the invention have been described and that numerous substitutions, modifications and alterations are permissible without departing from the spirit and scope of the invention as defined in the following claims.

I claim:

1. A clip for attaching a desired element to a fence post formed with a vertical recess therein, said attaching clip comprising:

(a) a front base portion being reversely folded upon itself at its opposite lateral edges, said front base portion before installation of said clip to the post having a generally arcuate configuration and after installation of said clip to the post being capable of being deformably flattened toward the post from said arcuate to a generally planar configuration for locking said clip to the post;

(b) a pair of side anchor portions each merging from one of said reversely folded opposite lateral edges of said front base portion and projecting generally rearwardly therefrom and in laterally spaced relation from one another, said side anchor portions being in an unlocking relation when said front base portion is in its arcute configuration for permitting insertion of said anchor portions into the post recess, said side anchor portions capable of being rotated rearwardly and outwardly away from one another to a locking relation upon flattening of said front base portion from its generally arcuate to planar configuration; and (c) a securing portion attached to and projecting from one of a bottom or top edge of said front base portion for receiving an element to be secured to the post and for capturing the element once said clip has been installed to the post and said front base portion deformably flattened from its generaly arcuate to planar configuration.

2. The attaching clip of claim 1 wherein:

said securing portion is a flange projecting downwardly and forwardly from said bottom edge of said front base portion of said clip and then projecting rearwardly therefrom past said bottom edge.

3. The attaching clip of claim 1 wherein:

said side anchor portions are C-shaped flanges being disposed in back-to-back spaced relation with their convex sides facing each other and their free edges facing outwardly away from each other.

4. The attaching clip of claim 3 wherein:

said free edge of each of said C-shaped flanges is acute and serves to bite into an adjacent portion of the post within the recess thereof when said front base portion of said clip is flattened to lock said clip to the post.

5. The attaching clip of claim 1 wherein:

each of said side anchor portions rotate outwardly to resiliently engage an adjacent portion of the post within the recess thereof when said front base portion of said clip is flattened to lock said clip to the post.

6. In combination a fence system including the clip as defined in claim 1 secured to an elongated metal channel having inwardly turned outer edges and said side anchor portions engaging said turned edges.

7. A fence system according to claim 6 in which the channel is embedded in cementitious material.

* * * * *